United States Patent [19]

Frye

[11] 4,135,634

[45] Jan. 23, 1979

[54] CONTAINER OR LIKE STRUCTURE

[76] Inventor: Lance C. Frye, R.R. 4, Davenport, Iowa 52800

[21] Appl. No.: 689,057

[22] Filed: May 24, 1976

[51] Int. Cl.[2] ..... B65D 7/04; A63C 19/10; F25D 1/00

[52] U.S. Cl. ..... 220/5 A; 4/177 R; 62/56; 62/235; 285/419; 285/DIG. 4; 220/404; 220/441

[58] Field of Search ..... 52/23, 245, 249, 169; 220/1 B, 63 R, 1 R, 404, 441.5 A; 160/402; 4/177 R, 172; 24/243 K, 243 M, 243 N; 138/155, 173; 62/56, 235; 285/DIG. 4, 419

[56] References Cited

U.S. PATENT DOCUMENTS

| | | | |
|---|---|---|---|
| 319,144 | 6/1885 | Stephens et al. | 285/DIG. 4 |
| 1,931,694 | 10/1933 | Hall | 138/173 |
| 2,754,518 | 7/1956 | Vary | 24/243 K |
| 2,861,277 | 11/1958 | Hermann | 220/76 |
| 2,989,757 | 6/1961 | Friedlander et al. | 4/172 |
| 3,933,002 | 1/1976 | Vickery | 4/177 |

*Primary Examiner*—William Price
*Assistant Examiner*—Allan N. Shoap

[57] ABSTRACT

A container or like structure having a corrugated tubular base or wall at least partly embraced by a thin, pliable sheet clamped in place by a like corrugated collar embracing both the sheet and the tube so that the corrugations intermesh, deforming and securely holding the sheet.

10 Claims, 8 Drawing Figures

CONTAINER OR LIKE STRUCTURE

BACKGROUND OF THE INVENTION

One area in which the invention finds particular utility is in the construction of inexpensive, rapidly built ice skating rinks, one example of which is disclosed in the U.S. patent to Vickery, U.S. Pat. No. 3,933,002. According to that patent, a tubular member is laid out as a closed loop or geometrical pattern and a sheet overlies the tube so formed, lapping over the tube along the edges of the sheet and the middle of the sheet being depressed to ground level to form a shallow cup-like container. The tube is filled with water (subsequently frozen) or some other substance such as foam rubber to lend rigidity, and the 37 cup" is filled with water which is subsequently frozen. The edges of the sheet are retained clamped to the tube by wire or like bails spaced about the periphery of the pattern.

There are several disadvantages to a construction of this type. First, the clamp members, being spaced apart, expose the sheet — which is conventionally the well-known polyethylene material — to damage from the skaters stepping on it at the tube area, and consequently some form of additional protective means, such as mats, must be provided. Second, since the tube is not self-sustaining and must be filled with water and then frozen, the structure does not lend itself to warm-weather use; e.g., as wading pools for children, rock gardens, fountains, etc. Third, the wire clamps leave much to be desired in the way of adequate connection of the sheet to the tube. Fourth, if the tube is filled with a foamed substance rather than frozen water, the cost and weight are increased, besides which problems arise when the rink, for example, is dismantled for warm weather.

SUMMARY OF THE INVENTION

According to the present invention, the foregoing problems are avoided and may advantages are availed of because of the use of conventional materials discovered to be of special use in structural areas of the class described. For example, conventional plastic corrugated drain tile is used as the base or foundation. This tubing normally comes in a diameter of roughly 3½ and the annular corrugations are spaced apart by about 9/16. Two well-known types are "PVC" (polyvinyl chloride) and "ABS" (acrylonitrile butadiene styrene). These materials have the characteristics of being substantially indestructible, having high diametral resistances to deformation, are water and corrosion resistant, light in weight, relatively inexpensive and capable of turning corners; i,e., they will take several changes in direction, up to 90° on a fairly small radius, thus adapting themselves, for present purposes, to formations of circles, rectangles, ellipses, etc.

The clamping means is a length of like tubing from which a longitudinal section of the wall has been removed, leaving a C-shaped section, and this is sufficiently springy to allow spreading over the tube as embraced by the sheet and to return to form to securely grasp or clamp the sheet. What is more, the corrugations of the tube and collar intermesh, deforming the pliable sheet between them and securely gripping it in place.

A further feature is that the collar and tube may be coextensive in peripheral extent and the collar, being substantially indestructible, eliminates the requirement for special mats to protect the tube-carried part of the sheet from damage, as by ice skates. Furthermore, the juncture of the collar ends can be offset from the juncture of the tube ends, and thus the two members serve to secure each other together in the chosen geometrical pattern.

The structure is easily disassembled, for once an end of the collar is pulled away from the tube, there is a sequential "zipper effect" as the corrugations separate.

Since the tube is self-supporting — i.e., needs no internal support — its "emptiness" can be exploited for other purposes; e.g., accomodating water pipes, hoses, etc. when the structure is used as a fountain; accomodating electrical conduits when used as a rock garden, display, etc. In the event that the structure is used in an environment requiring associated concrete, the corrugations can "mesh with" with the concrete and hold the structure in place. In cases of installation on windy days, for example, the corrugations enable the tube to hold a certain amount of water to give added weight to prevent the parts from shifting, blowing, etc. Above all, the tubing is commercially available at low expense and can be readily adapted to the uses contemplated here.

DESCRIPTION OF A PREFERRED EMBODIMENT

Figure 2:
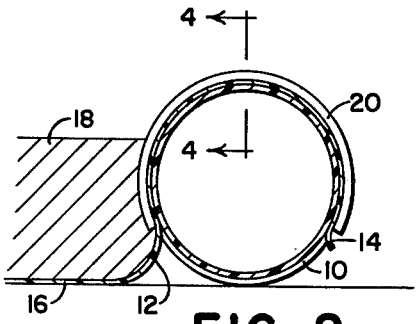
FIG. 2 is an enlarged section on the line 2—2 of FIG. 1.
Figure 3:
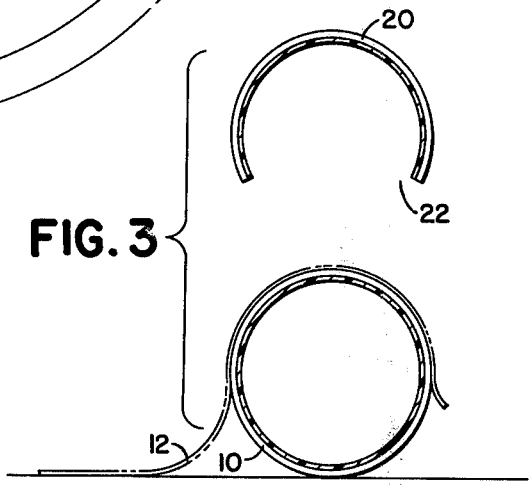
FIG. 3 is a view on the scale of FIG. 2, showing the pre-assembly of the components.

Purely for purpose of illustration, the structure is depicted here as having a circular peripheral wall, provided, according to the invention, by a corrugated tube 10 of circular cross-section, best seen in FIGS. 2 and 3. As already stated, this tube is preferably of conventional plastic drain tile, two types of which have been referred to above. Because this tube is substantially indestructible yet bendable, it may be formed in selected contours, the circular pattern being representative. Diameterwise, the tube is virtually non-deformable and therefore needs no internal support.

Figure 1:
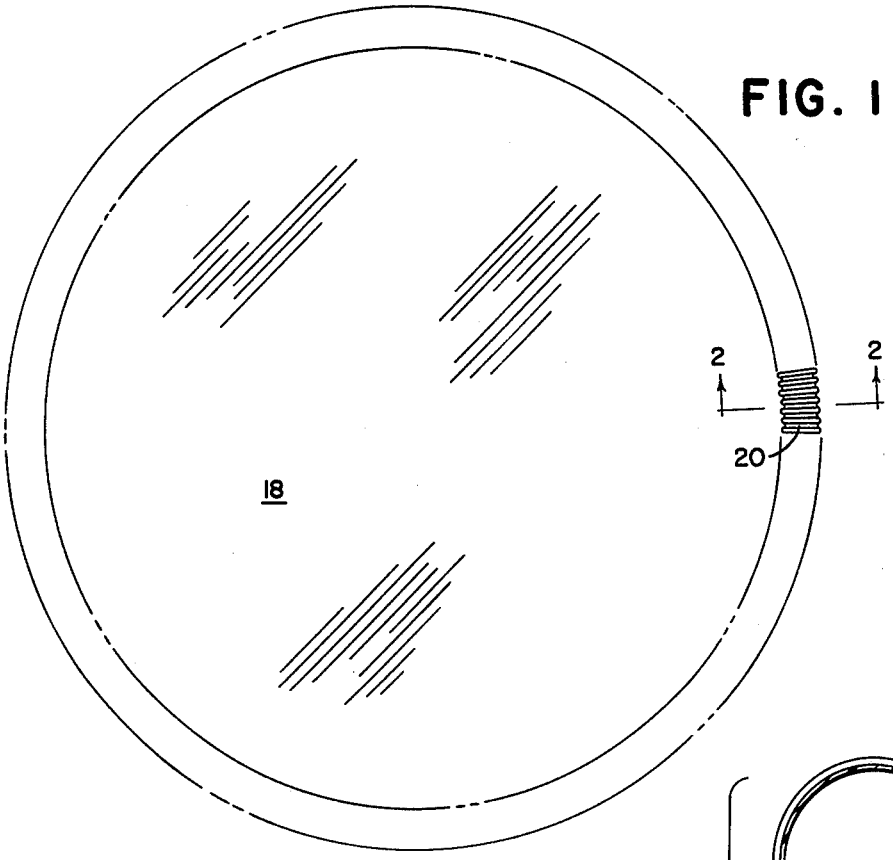
FIG. 1 is a representative plan view of an ice skating rink, shown partly in dot-dash lines for convenience.

After the closed loop or other selected pattern is formed of the tube, it is over-lain by a sheet 12 of thin, pliable material, such as conventional sheet material used for drop cloths, trash bags, temporary building enclosures, etc. The size of the sheet is of course chosen on the basis of the pattern of the basic wall established by the tube 10. As will be seen, edge portions of the sheet partly embrace the tube 10 from above, outer portions being draped over the tube as at 14 in FIG. 2, and the interior part of the sheet is depressed, as to ground level, as at 16 in FIG. 2, to form what may be termed a relatively shallow cup, at last for forming the structure chosen here by way of example. If the structure is to be used as an ice-skating rink, it will be filled with water, which is subsequently frozen, as best shown at 18 in FIGS. 1 and 2.

Figure 4:
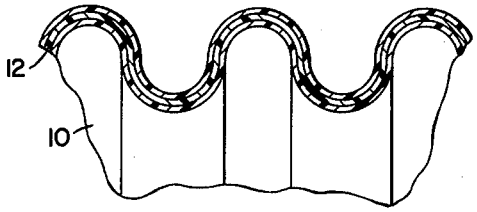
FIG. 4 is an enlarged fragmentary section on the line 4—4 of FIG. 2.

After the sheet and the tube are laid out as above described, the sheet is clamped to the tube by clamp collar means 20. This is a length of tubing just like the tube 10 but from which a section of the wall has been cut out to provide a mouth or gap 22, thus giving the member or collar a C-shaped section of at least, but preferably more than, a semicircle. Even though the tube and collar material is substantially rigid, the collar, because of being cut out at 22, can be "sprung" apart so that the mouth widens enough to be slipped over the tube-carried sheet, as will be seen from a comparison of FIGS. 2 and 3. Once the collar is in place, it recovers its shape and securely clamps the sheet to the tube. Of significance is the fact that the similar corrugations of the tube and collar intermesh and deform the pliable sheet between them, best seen in FIG. 4, to establish a connection that cannot become accidentally separated.

Figure 6:
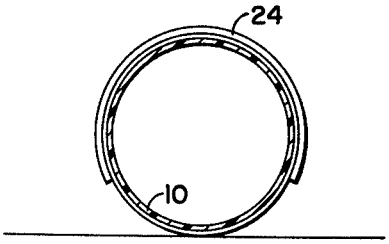
FIG. 6 is a reduced section on the line 6—6 of FIG. 5.
Figure 7:
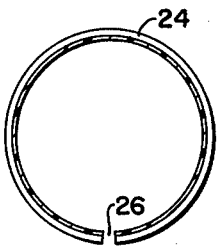
FIG. 7 is a section, on the scale of FIG. 6, of the connecting collar per se.
Figure 5:
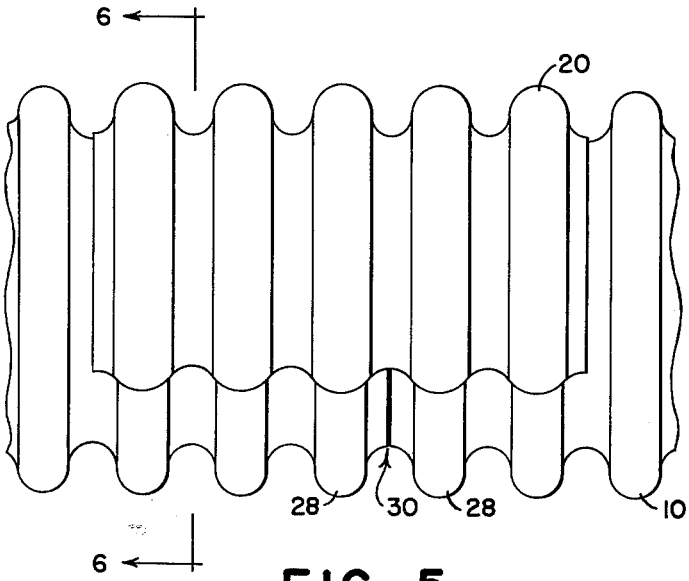
FIG. 5 is a further enlarged fragmentary section of an embodiment using a separate connector for the ends of the base tube or wall.

Before the tube 10 is covered with the sheet 12, its ends must be interconnected so that the selected pattern is retained. One way of doing this is illustrated in FIGS. 5, 6, and 7, wherein is shown a connecting collar 24, also formed of a short length of the same tubing as the members 10 and 20 but having a slit 26 therein, giving the collar a C-shaped section. Again, the plastic tile material is sufficiently yieldable, after being cut at 26, to enable its lips to be spread apart so that it can embrace the opposite terminal end parts 28 where they meet at a juncture 30. After this connection is made, the sheet is put in place, followed by the clamp collar as described above. It will be understood that the wall section of the tubing material is quite thin and the assembly is easily and quickly made, but when the installation is complete, the structure becomes surprisingly rigid and, before filled with water, etc., may be moved about. This enables pre-fabrication if circumstances require, especially where smaller structures are being used, as in pools, rock gardens, etc.

Figure 8:
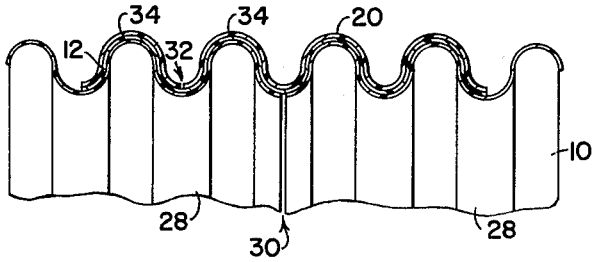
FIG. 8 is a section on the scale of FIG. 5, showing the clamping collar and tube and the manner in which the two cooperate to interconnect each other end-to-end.

FIG 8 shows another way of joining the ends 28 of the tube 10 at their juncture 30. In this way, the clamp collar 20 serves the dual purpose of making the connection and clamping the sheet 12, and this is achieved by peripherally offsetting the juncture 32 of the collar ends 34 relative to the juncture 30 of the tube ends 28, as will be best seen in FIG. 3. The intermeshing corrugations preclude relative peripheral shifting of the clamp collar and tube.

Since the entire peripheral portion of the sheet is covered by the clamp collar 20, because the collar and tubing are preferably coextensive in length, the sheet thereat is amply protected, as against ice skate damage when the structure is used as a rink. In view of the absence of internal means in the tube, the structure is extremely simple, light in weight and considerably less expensive than structures heretofore known. As noted above, the interior of the tube may be used to accommodate conduits of various types, as where the structure is used with lighting, as in rock gardens, fountains, etc. Because the materials used are readily available, the structure may be rapidly assembled. Also, it may be easily disassembled, because the clamp collar may be readily stripped from the sheet and tube 10, being literally "unzipped". The parts may be re-used, it being only the sheet that may need replacement for various reasons.

I claim:

1. A container structure of the type having a peripheral wall overlain by a sheet of relatively thin pliable material so that the edge of the sheet partly embraces the wall from above and with the sheet portion within the inner periphery of the wall depressed to form a cup-shaped receptacle for containing liquid and the like, and clamp means for securing the edge of the sheet to and partly about the wall, characterized in that the wall is an annularly corrugated tube of substantially circular section and of relatively stiff material capable of retaining its shape without internal support, and the clamp means is a similar, similarly corrugated tube having a lengthwise portion thereof cut out to provide a clamp collar of at least semi-circular section and fitted over the tube and tube-embracing edge of the sheet with the corrugations of the collar meshing with those of the tube and deforming the sheet edge therebetween.

2. The invention defined in claim 1, further characterized in that the clamp collar is substantially peripherally coextensive with the tube.

3. The invention defined in claim 2, further characterized in that the wall tube has its opposite terminal ends meeting at an end-to-end juncture, the clamp collar has its opposite terminal ends meeting at an end-to-end juncture, and the two junctures are peripherally offset so that a portion of the clamp collar bridges the tube juncture for securing the tube and collar together.

4. The invention defined in claim 1, further characterized in that the tube has opposite terminal ends meeting at an end-to-end juncture, and means is provided at said juncture for securing said ends together.

5. The invention defined in claim 4, further characterized in that the securing means includes a third member of corrugated tubing like the tube and clamp collar and having a lengthwise wall portion cut away to form substantially a C, said third part likewise being corrugated to match the tube and collar and being capable of being spread apart sufficiently to embrace the tube ends and to spring back to shape in bridging relation to said juncture and having its corrugations meshing with those of the tube for securing the tube ends together, and the clamp collar embraces the third part as well as the sheet edge and tube.

6. The invention defined in claim 1, further characterized in that the clamp collar is substantially greater than semi-circular in cross section and the clamp collar material is capable of spreading apart to fit over the tube and sheet edge and is further capable of recovering its shape so as to tightly embrace the tube and sheet edge.

7. The invention defined in claim 1, further characterized in that the tube and clamp collar are formed of conventional plastic drain tile.

8. The invention defined in claim 1, further characterized in that the tube and collar are of material selected from the group including polyvinyl chloride and acrylonitrile butadiene styrene.

9. The combination of a length of tubing of relatively thin-walled substantially non-crushable material of circular cross-section having uniform annular corrugations, a sheet of thin, relatively pliable material at least partly embracing the tubing, and a clamp collar of like corrugated tubing having a lengthwise wall section cut away to give the collar a C-shaped section and providing a lengthwise gap, said collar material being such as to enable the collar to be spread apart enough to enable the gap to widen and thus slip over and embrace the sheet edge and tubing and to spring back to shape for tightly clamping the sheet edge and tube, the two sets of corrugations intermeshing and deforming the sheet edge between them.

10. The invention defined in claim 9, further characterized in that the tubing and collar are of material selected from the group including polyvinyl chloride and acrylonitrile butadiene styrene.

* * * * *